US007387440B2

(12) United States Patent
Li

(10) Patent No.: US 7,387,440 B2
(45) Date of Patent: Jun. 17, 2008

(54) VACUUM STORAGE BAG

(76) Inventor: Man Chiu Li, No. 2, 3/F., Crown Ind. Bldg., 106 How Ming Street, Kwun Tong, Kin., Hong Kong (CN)

( * ) Notice: Subject to any disclaimer, the term of this patent is extended or adjusted under 35 U.S.C. 154(b) by 560 days.

(21) Appl. No.: 10/504,017

(22) PCT Filed: Feb. 4, 2002

(86) PCT No.: PCT/CN02/00057

§ 371 (c)(1),
(2), (4) Date: Aug. 4, 2004

(87) PCT Pub. No.: WO03/066473

PCT Pub. Date: Aug. 14, 2003

(65) Prior Publication Data

US 2005/0082193 A1 Apr. 21, 2005

(51) Int. Cl.
*B65D 33/00* (2006.01)
*B65D 33/01* (2006.01)
*B65D 81/20* (2006.01)

(52) U.S. Cl. ..... 383/93; 383/100; 206/524.8

(58) Field of Classification Search ..... 383/93, 383/95, 100–103, 109; 206/524.8
See application file for complete search history.

(56) References Cited

U.S. PATENT DOCUMENTS 2,764,859 A * 10/1956 Hanselmann ..... 53/434
3,247,957 A * 4/1966 Kemble ..... 206/440
RE30,045 E * 7/1979 Greene ..... 378/184
4,720,011 A * 1/1988 Canamero ..... 206/455
4,877,526 A * 10/1989 Johnson et al. ..... 210/448
5,123,535 A * 6/1992 Patnode et al. ..... 206/438
5,447,235 A * 9/1995 Pharo ..... 206/522
5,588,532 A * 12/1996 Pharo ..... 206/522
5,772,034 A * 6/1998 Lin ..... 206/522
5,827,586 A * 10/1998 Yamashita et al. ..... 428/36.6
5,840,091 A * 11/1998 Strong ..... 55/385.1
6,220,702 B1 * 4/2001 Nakamura et al. ..... 347/86
7,036,988 B2 * 5/2006 Olechowski ..... 383/210.1
2004/0000503 A1 * 1/2004 Shah et al. ..... 206/524.8

FOREIGN PATENT DOCUMENTS

JP 05051040 A * 3/1993
JP 05124656 A * 5/1993 ..... 206/524.8

* cited by examiner

*Primary Examiner*—Jes F Pascua

(57) ABSTRACT

The present invention relates to a vacuum storage bag for daily use. The vacuum storage bag comprises a sealable body with an opening at one end and a pressed and sealed end at the other end; the sealable body is formed by two layers and each layer is made of two layers; the inner surfaces of the opening are coated with a layer of adhesive material; and the sealed and pressed end has a tubular opening at its bottom. It is convenient to use and of simple construction. It is suitable for storing articles in a vacuum state with limited space and preventing the articles from mildewing.

4 Claims, 2 Drawing Sheets

VACUUM STORAGE BAG

BACKGROUND OF THE INVENTION

The present invention relates to storage bags and more particularly pertains to a vacuum storage bag for daily use.

The available vacuum storage bags in the marketplace have one or mare rubber or plastic seals or fastening tape available under the VELCRO trademark which consists of a strip of nylon with a surface of minute hooks that fasten to a corresponding strip with a surface of uncut pile at the bag openings. Some of these bags have openings in the bag bodies and the openings are covered by caps of construction similar to that of soft drink bottle caps. The method of usage is to first open the seals or VELCRO, put articles such as a cotton-padded quilt into the bag and then close the seals or VELCRO and thereafter, open the cap and insert the hose of a vacuum cleaner to suck away all the air inside the bag, then remove the hose and close the opening with the cap, thereby creating a vacuum state inside the bag and preventing air from entering the beg.

There are some storage bags of smaller size which can achieve the vacuum effect without the assistance of vacuum cleaners. The method is to hot press two strips at the opening at the other end of the bag and the strips are a bit shorter in length than the opening of the bag. In the same manner, it is to first open the seals or VELCRO, put articles such as clothes into the bag and then close the seals or VELCRO securely, and thereafter, push by hands the air out of the bag from the end with the seals or VELCRO to the other end with the strips and thus create a vacuum state inside the bag and prevent air from entering the bag.

However, gas or liquid usually enters the vacuum storage bag through the gaps on it that are hardly perceivable by human eyes, or the gaps of the seals or VELCRO, or the gaps between the cap and the opening, or through the opening of the strips. As a result, the vacuum effect is destroyed. In order to maintain the vacuum state inside the bag, manufacturers have suggested users to suck away the air once every several months. This practice is troublesome and time consuming, and cannot solve the problem once and for all. In addition, the opening with the cap of construction similar to that of a soft drink bottle cap is generally made of hard plastics. If the user Is not careful, the opening with the cap will easily damage the neighboring articles or the vacuum storage bag itself or the articles of clothing inside the bag.

BRIEF SUMMARY OF THE INVENTION

In view of the aforesaid disadvantages now present in the prior art, the present invention provides a vacuum storage bag which is formed in one piece and does not comprise any hard components and which can effectively prevent gas and liquid from entering the vacuum storage bag.

To attain this, the present invention generally comprises a vacuum storage bag, comprising a sealable body with an opening at a first end and the other end of which is sealed by pressing; the sealable body is formed by two layers which include a top layer and a bottom layer; the opening has an inner surface which is coated with a layer of adhesive material which achieves adhesive effect by smoothly adhering to each other; and the sealed and pressed end is connected to a tubular unit which has an opening at the bottom end of the tubular unit.

On the two external sides of the opening, there are two semi-circular protrusions, one on each side.

The two inner surfaces of the sealable body are coated with a layer of adhesive material.

The vacuum storage bag further comprises a tubular sleeve which is removably connected to the sealable body.

One end of the tubular sleeve has an opening and the other end is sealed.

The tubular sleeve is made of a mesh material which facilitates a hose of a vacuum machine to enter the tubular unit.

The inner surface of the tubular opening is coated with a layer of adhesive material.

The tubular sleeve is made of air-permeable material.

When two pieces of the adhesive material are attached together, they will automatically adhere to each other. If they are smoothly adhered to each other, there will be no gaps in between and air cannot pass through.

To use the vacuum storage bag, the user first opens the bag opening and puts the articles inside the bag. The user then seals the opening which is made of the adhesive material. In order to allow the adhesive material adheres more smoothly, the user may grasp the semi-circular protrusions, one on each side, and then pull by force. The opening adheres more smoothly owing to the tension. The user may also apply a soft article to flatten the opening, facilitating a smoother adhesion. Thereafter, the user inserts the hose of a vacuum cleaner into the tubular sleeve which is made of air-permeable material, and then inserts into the tubular opening, the inner surface of which is made of the adhesive material, and the vacuum cleaner sucks away the air inside the bag. The user then removes the hose of the vacuum cleaner from the bag and the user makes the adhesive material of the tubular opening adheres together smoothly while the hose is being removed, thereby creating a vacuum state inside the bag and preventing air from entering the bag. The tubular sleeve is made of air-permeable material, which can prevent the adhesive material from adhering to the hose of the vacuum cleaner so that the hose can be easily inserted and removed.

After the air inside the bag is sucked away, the air density and pressure outside the bag are high whereas the air density and pressure outside are low, and so the adhesive material is adhered together securely, and the storage bag can achieve a vacuum state.

It is an object of the present invention to provide a new vacuum storage bag which, in contrary to the existing vacuum storage bags, is formed in one piece and does not comprise any hard components and which can effectively prevent gas and liquid from entering the vacuum storage bag.

It is another object of the present invention to provide a new vacuum storage bag which is convenient to use.

It is a further object of the present invention to provide a new vacuum storage bag which is of simple construction and is susceptible of a low cost of manufacture.

An even further object of the present invention is to provide a new vacuum storage bag which is for daily household use for storing articles in a vacuum state with limited space and effectively preventing the articles from mildewing.

DETAILED DESCRIPTION OF THE INVENTION

Figure 1:
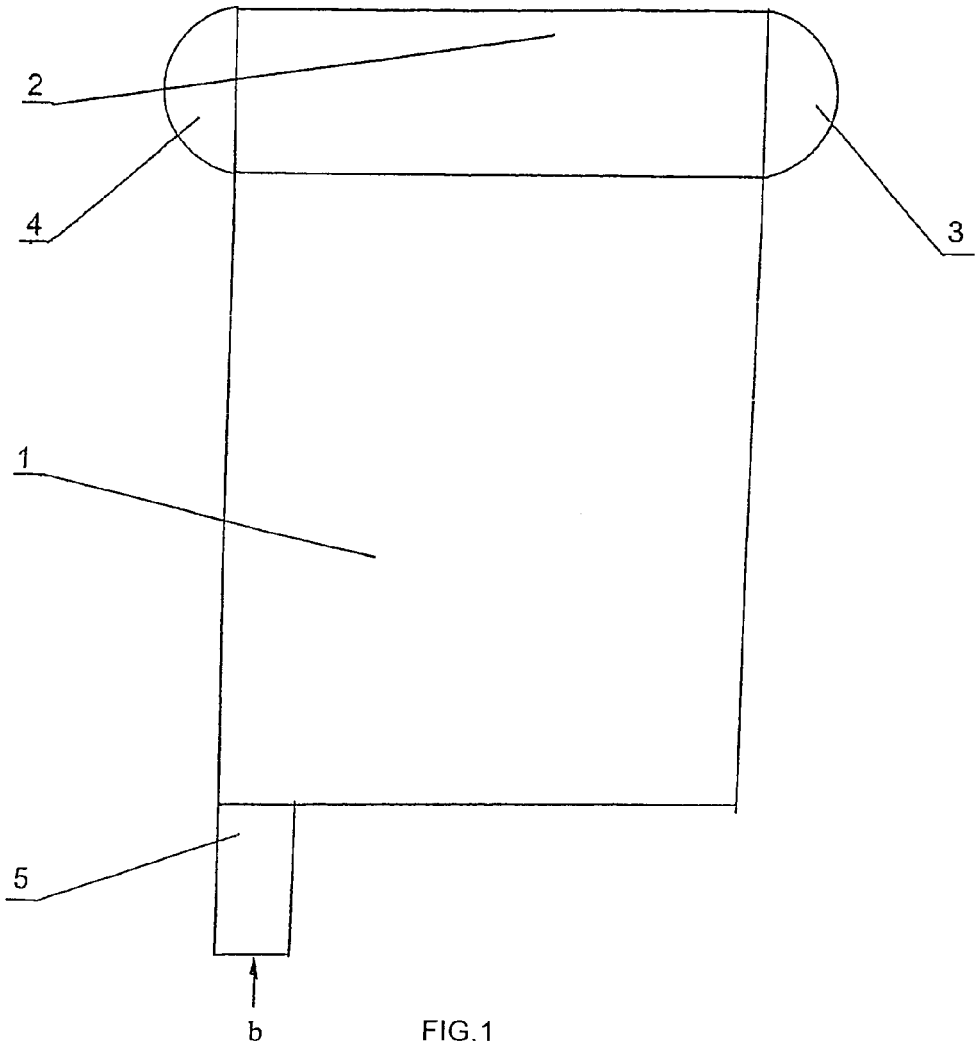
FIG. 1 shows the structure of the present invention.

As illustrated in FIGS. 1. 1*a* and 1*b*, the vacuum storage bag generally comprises a bag 1 made up of two layers, an opening 2 coated with a layer of adhesive material in an inner surface 7 thereof, semi-circular protrusions 3, 4 located on the two external sides of the opening, a tubular unit 5 coated with a layer of adhesive material on its inner surface 8 at the bottom end, with an opening b.

Figure 2:
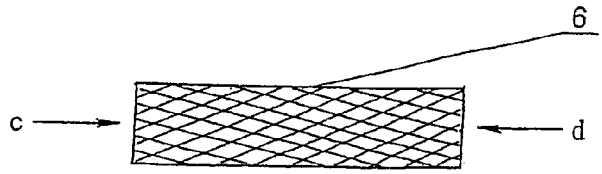
FIG. 2 shows the structure of the air-permeable tubular sleeve of the present invention.
Figure 1A:
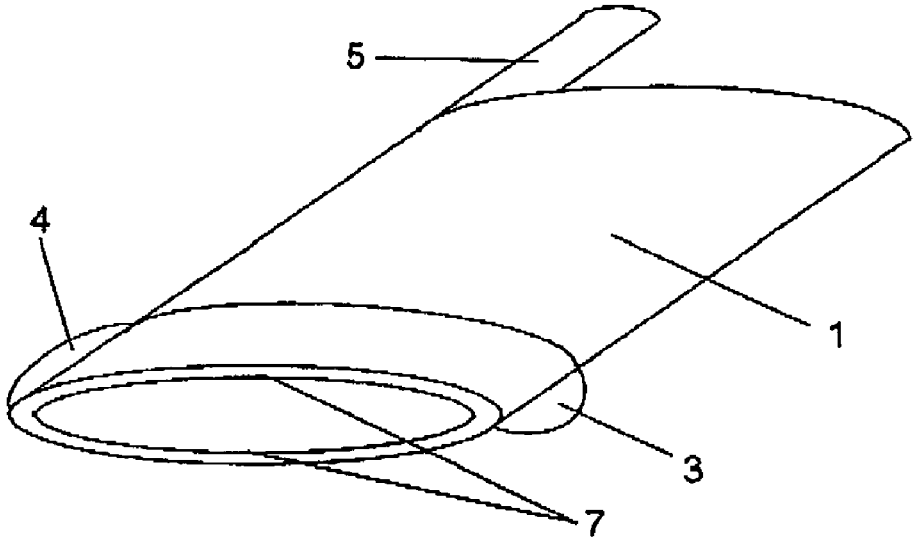
FIG. 1*a* shows a perspective view of the present invention.
Figure 1B:
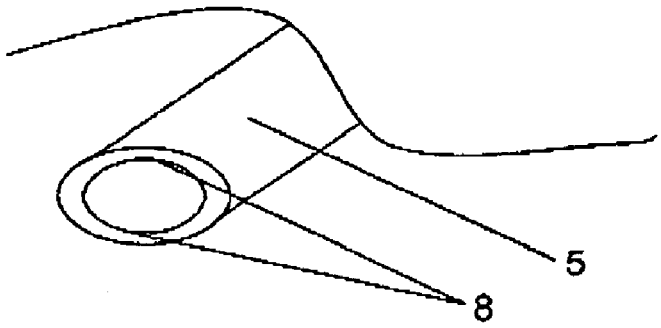
FIG. 1*b* shows a perspective view of the tubular unit of the present invention.

As illustrated in FIG. 2, a tubular sleeve 6 is made up of air-permeable material, and one end of the tubular sleeve 6 is sealed c and the other end has an opening d.

As illustrated in FIGS. 1 and 2, the two inner surfaces of the opening 2 of the bag 1 which is made up of two layer material are sealed by the adhesive material thereon. On the two external sides of the opening, there are two semi-circular protrusions 3, 4. The other end of the bag has the tubular unit 5 which is made of the adhesive material. There is also a tubular sleeve 6 which is made up of air-permeable material, and it can be inserted into the tubular unit 5.

When two pieces of the adhesive material are attached together, they will automatically adhere to each other. If they are smoothly adhered to each other, there will be no gaps in between and air cannot pass through.

The usage method is to open the bag opening and put the articles inside the bag. The user then seals the opening which is made of the adhesive material. In order to allow the adhesive material adheres more smoothly, the user may grasp the semi-circular protrusions, one on each side, and then pull by force. The opening adheres more smoothly owing to the tension. The user may also apply a soft article to flatten the opening, facilitating a smoother adhesion. Thereafter, the user inserts the hose of a vacuum cleaner into the tubular sleeve which is made of air-permeable material, and then inserts into the tubular unit, the inner surface of which is made of the adhesive material, and the vacuum cleaner sucks away the air inside the bag. The user then removes the hose of the vacuum cleaner from the bag and the user makes the adhesive material of the tubular unit adheres together smoothly while the hose is being removed, thereby creating a vacuum state inside the bag and preventing air from entering the bag. The tubular sleeve is made of air-permeable material, which can prevent the adhesive material from adhering to the hose of the vacuum cleaner so that the hose can be easily inserted and removed.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A vacuum storage bag comprising a sealable body with an opening at a first end and a pressed and sealed end opposite the first end; the sealable body is formed by two layers which include a top layer and a bottom layer; the opening has an inner surface which is are coated with a layer of adhesive material which achieves adhesive effect by smoothly adhering to each other; and the sealed and pressed end is connected to a tubular unit which has an opening at the bottom end of the tubular unit; the vacuum storage bag further comprises a tubular sleeve which is removably connected to the sealable body, and one end of the tubular sleeve has an opening and the other end is sealed.

2. A vacuum storage bag as in claim 1, wherein the opening has two external sides, and there are two semi-circular protrusions, one on each side; the two semi-circular protrusions serves as a means for a user to grip and pull so as to facilitate smooth adhesion of the inner surface of the opening coated with the adhesive material.

3. A vacuum storage bag as in claim 1, wherein the tubular sleeve is made of a mesh material which facilitates a hose of a vacuum machine to enter the tubular unit.

4. A vacuum storage bag as in claim 1, wherein the tubular unit has an inner surface which is coated with a layer of adhesive material.

* * * * *